US005884685A

United States Patent [19]

Umezawa et al.

[11] Patent Number: 5,884,685

[45] Date of Patent: Mar. 23, 1999

[54] QUALITY PREDICTION AND QUALITY CONTROL OF CONTINUOUS-CAST STEEL

[75] Inventors: Kazushige Umezawa; Takehiko Toh, both of Chiba; Makoto Tanaka, Aichi; Eiichi Takeuchi; Takeo Inomoto, both of Chiba, all of Japan

[73] Assignee: Nippon Steel Corporation, Tokyo, Japan

[21] Appl. No.: 737,965

[22] PCT Filed: Mar. 26, 1996

[86] PCT No.: PCT/JP96/00871

§ 371 Date: Nov. 26, 1996

§ 102(e) Date: Nov. 26, 1996

[87] PCT Pub. No.: WO96/30141

PCT Pub. Date: Oct. 3, 1996

[30] Foreign Application Priority Data

Mar. 29, 1995 [JP] Japan ..... 7-072092

[51] Int. Cl.[6] ..... B22D 11/16

[52] U.S. Cl. ..... 164/453; 75/376; 75/386; 164/150.1; 164/154.1; 164/155.1; 164/452; 164/451

[58] Field of Search ..... 164/451, 452, 164/453, 150.1, 151.2, 154.1, 154.5, 155.1, 155.4, 155.7; 75/376, 386; 266/78, 79, 80

[56] References Cited

U.S. PATENT DOCUMENTS 5,375,816 12/1994 Ryan et al. ..... 164/155.4 X
5,527,377 6/1996 Miwa et al. ..... 164/452 X
5,633,462 5/1997 Heaslip et al. ..... 164/453 X

FOREIGN PATENT DOCUMENTS 61-144254 7/1986 Japan ..... 164/451
63-238957 10/1988 Japan .
64-70134 3/1989 Japan .
2-11257 1/1990 Japan .
3-102258 4/1991 Japan .
4-266470 9/1992 Japan ..... 164/154.1
5-104205 4/1993 Japan .
6-114501 4/1994 Japan .
7-239327 9/1995 Japan .
WO 91/17009 11/1991 WIPO .

OTHER PUBLICATIONS

The Iron and Steel Institute of Japan (ISIJ), vol. 35, No. 5, 1995, pp. 474–479.

*Primary Examiner*—J. Reed Batten, Jr.
*Attorney, Agent, or Firm*—Kenyon & Kenyon

[57] ABSTRACT

A rapid analysis device for analyzing nonmetallic inclusions in steel by a cold crucible method is combined with a mathematical model, and the quality of cast steel is predicted online by simulating the behavior. of the nonmetallic inclusions by calculation. Further, continuous casting process variables are controlled to minimize the amount of nonmetallic inclusions in the cast steel.

26 Claims, 8 Drawing Sheets

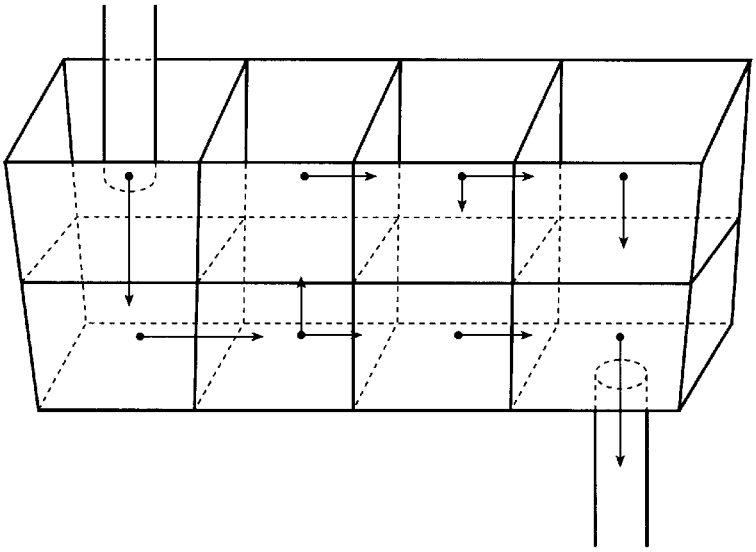
FIG. 3
FIG. 4A
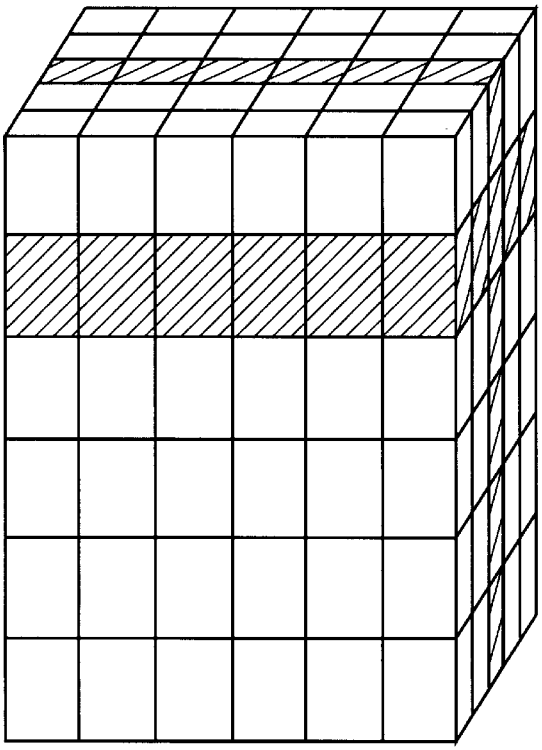
FIG. 4B
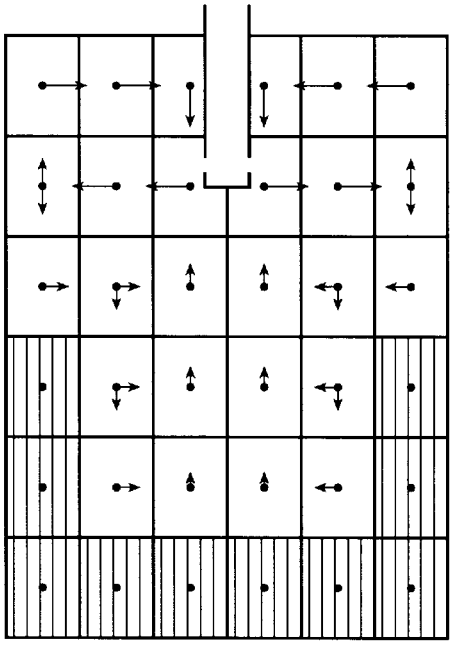
FIG. 4C
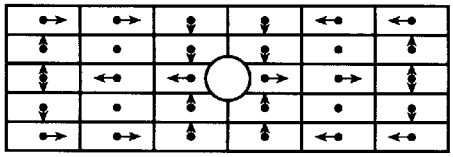

QUALITY PREDICTION AND QUALITY CONTROL OF CONTINUOUS-CAST STEEL

TECHNICAL FIELD

The present invention relates to a method and apparatus, used in a continuous casting process of steel, for predicting online the quality of the molten steel during casting and the quality of the cast steel, a method and apparatus for on-line quality control based on the results of the prediction, and a storage medium for storing programs for implementing these methods.

BACKGROUND ART

Traditionally, the quality of cast steel produced by a continuous casting process is managed using operating indexes. When an abnormality is detected in any operating index, for example, when the amount of slag outflow from the ladle during an interval between charges is larger than a managed value, or when the submerged entry nozzle through which the molten steel in the tundish is poured into a mold has shown a tendency to clog because of the adhesion of nonmetallic oxide inclusions, or when the fluid condition on the meniscus (molten surface) of the molten steel in the casting mold has become asymmetrical about the submerged entry nozzle, then continuous-cast pieces corresponding to the portion where the abnormality was detected are closely examined for quality before being sent to the subsequent rolling process, and cast steel with low cleanliness is downgraded.

Even if the cast steel is not downgraded, the quality examination itself not only imposes a large burden on the work but also decreases the ratio of the cast pieces directly transferred to the rolling process to the total number of cast pieces produced (the direct transfer ratio), thus disturbing the matching between the continuous casting and the rolling process and leading to a substantial increase in production cost.

On the other hand, even when no abnormality is detected in the operating indexes and the cast steel is rolled as originally scheduled, there may be cases in which defects are discovered in the finished steel plates. after rolling. In such cases also, the yield of the finished products decreases, leading to a substantial increase in production cost.

The most commonly practiced methods for estimating the behavior of nonmetallic inclusions in molten steel in the continuous casting process include a simulation using a water model, a model calculation using a simple analytical solution, and even a simulation calculation by a numerical analysis for simulating the motion of fine particles in a turbulent flow. In implementing measures to reduce inclusions in molten steel, the knowledge obtained through these methods has been utilized, and techniques for controlling the molten steel flow in the continuous-casting mold by using novel tundish shapes and electromagnetic forces have been developed and are being implemented commercially.

Furthermore, rapid advances, in recent years, in the computational power of computers has made possible extremely precise estimation of the behavior of nonmetallic inclusions in the continuous casting process, and it is now possible to simulate agglomeration of nonmetallic inclusions and formation of new nonmetallic inclusions in molten steel in a turbulent flow.

However, the simulation for the formation of nonmetallic inclusions is no more than an estimation in a laboratory or on paper, and is conducted only for the purpose of explaining the behavior of nonmetallic inclusions in molten steel samples taken during casting or steel samples taken from cast steel on a macroscopic scale after the continuous casting, or of explaining on a macroscopic scale the effects of the measures or changes in operating conditions effected during operation, and obtaining equipment and operation indexes. Therefore, it has not been possible to apply such simulation to dynamic prediction of the nonmetallic inclusions in the molten steel during casting or of the internal quality of the resulting cast steel pieces.

The reasons are: (1) techniques capable of analyzing the behavior of nonmetallic inclusions with high accuracy have not been available, and it has not been possible to accurately set the conditions for the simulation calculation of their behavior; and (2) the traditional analysis methods have lacked speediness, and if prediction results with high accuracy are to be obtained, considerable time has had to be spent, as a result of which it has been extremely difficult to predict online the behavior of nonmetallic inclusions in cast steel during continuous casting.

DISCLOSURE OF THE INVENTION

It is an object of the present invention to provide a continuous casting method wherein, in a continuous casting process, the behavior of nonmetallic inclusions in molten steel as well as in cast steel is predicted using a mathematical model on the basis of recorded or estimated values relating to process operating conditions, while the behavior of the nonmetallic inclusions is measured using rapid analysis means by performing spot sampling at predetermined intervals of time during continuous casting and taking samples from predetermined places on the ladle, tundish, mold, and cast steel during the continuous casting, the obtained rapid analysis data being used to enhance the accuracy of the prediction by the mathematical model, thereby making possible on-line prediction of the composition, weight, inclusion size distribution, etc. of the nonmetallic inclusions in the continuously cast steel, and wherein process variables of the continuous casting are controlled online on the basis of the results of the prediction, to minimize the amount of the nonmetallic inclusions entrapped in the cast steel during solidification, thereby achieving the production of continuous-cast steel having excellent internal quality.

According to the present invention, there is provided a quality prediction method for continuous-cast steel, comprising the steps of: continuously calculating a nonmetallic inclusion distribution at an outlet of a ladle; continuously calculating a nonmetallic inclusion distribution at an outlet of a tundish by inputting the nonmetallic inclusion distribution calculated at the outlet of the ladle into a tundish mathematical model supplied with operation data of the tundish; and continuously predicting the quality of a steel piece cast in a mold by inputting the nonmetallic inclusion distribution calculated at the outlet of the tundish into a mold mathematical model supplied with operation data of the mold.

According to the present invention, there is also provided a quality control method for continuous-cast steel, comprising the steps of: continuously calculating a nonmetallic inclusion distribution at an outlet of a ladle; continuously calculating a nonmetallic inclusion distribution at an outlet of a tundish by inputting the nonmetallic inclusion distribution calculated at the outlet of the ladle into a tundish mathematical model supplied with operation data of the tundish; continuously predicting the quality of a steel piece cast in a mold by inputting the nonmetallic inclusion distribution calculated at the outlet of the tundish into a mold mathematical model supplied with operation data of the mold; and automatically changing operating conditions based on the predicted quality of the cast steel piece.

According to the present invention, there is also provided a quality prediction apparatus for continuous-cast steel, comprising: means for continuously calculating a nonmetallic inclusion distribution at an outlet of a ladle; means for continuously calculating a nonmetallic inclusion distribution at an outlet of a tundish by inputting the nonmetallic inclusion distribution calculated at the outlet of the ladle into a tundish mathematical model supplied with operation data of the tundish; and means for continuously predicting the quality of a steel piece cast in a mold by inputting the nonmetallic inclusion distribution calculated at the outlet of the tundish into a mold mathematical model supplied with operation data of the mold.

According to the present invention, there is also provided a quality control apparatus for continuous-cast steel, comprising: means for continuously calculating a nonmetallic inclusion distribution at an outlet of a ladle; means for continuously calculating a nonmetallic inclusion distribution at an outlet of a tundish by inputting the nonmetallic inclusion distribution calculated at the outlet of the ladle into a tundish mathematical model supplied with operation data of the tundish; means for continuously predicting the quality of a steel piece cast in a mold by inputting the nonmetallic inclusion distribution calculated at the outlet of the tundish into a mold mathematical model supplied with operation data of the mold; and means for automatically changing operating conditions based on the predicted quality of the cast steel piece.

According to the present invention, there is also provided a program storage device readable by a machine, tangibly embodying a program of instructions executable by the machine to perform method steps for predicting the quality of continuous-cast steel, said method steps comprising: continuously calculating a nonmetallic inclusion distribution at an outlet of a ladle; continuously calculating a nonmetallic inclusion distribution at an outlet of a tundish by inputting the nonmetallic inclusion distribution calculated at the outlet of the ladle into a tundish mathematical model supplied with operation data of the tundish; and continuously predicting the quality of a steel piece cast in a mold by inputting the nonmetallic inclusion distribution calculated at the outlet of the tundish into a mold mathematical model supplied with operation data of the mold.

According to the present invention, there is also provided a program storage device readable by a machine, tangibly embodying a program of instructions executable by the machine to perform method steps for controlling the quality of continuous-cast steel, said method steps comprising: continuously calculating a nonmetallic inclusion distribution at an outlet of a ladle; continuously calculating a nonmetallic inclusion distribution at an outlet of a tundish by inputting the nonmetallic inclusion distribution calculated at the outlet of the ladle into a tundish mathematical model supplied with operation data of the tundish; continuously predicting the quality of a steel piece cast in a mold by inputting the nonmetallic inclusion distribution calculated at the outlet of the tundish into a mold mathematical model supplied with operation data of the mold; and automatically changing operating conditions based on the predicted quality of the cast steel piece.

BRIEF DESCRIPTION OF THE DRAWINGS

FIG. 3 is a diagram showing an example of calculation meshes in a prediction model for predicting nonmetallic inclusions in a tundish;

FIG. 4 is a diagram showing an example of calculation meshes in a prediction model for predicting nonmetallic inclusions in a mold;

BEST MODE FOR CARRYING OUT THE INVENTION

Figure 1:
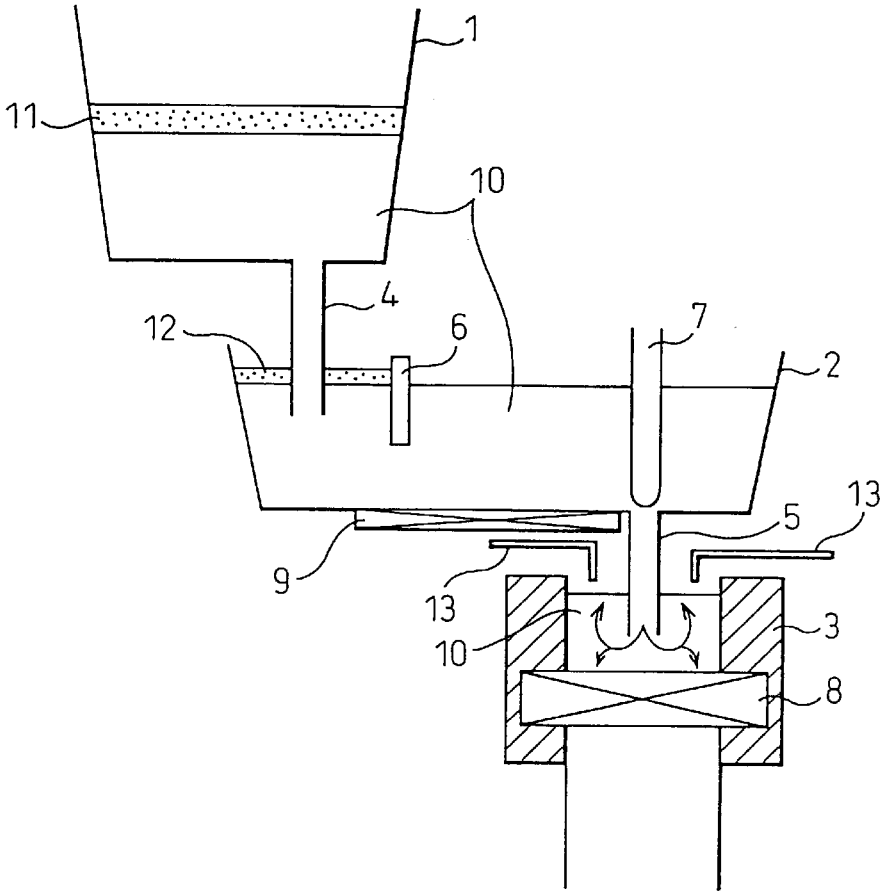
FIG. 1 is a diagram for schematically explaining a continuous casting process.

The present inventor et al. has previously proposed, in Japanese Unexamined Patent Publication No. 7-239327, a method of evaluating inclusions in molten steel using a cold crucible. According to this method, the steel melted by high-frequency induction heating in a copper cold crucible partitioned into a plurality of segments allows nonmetallic inclusions to float to the surface of the molten steel by electromagnetic pressures and fluid motion of the molten steel. The inclusions are prevented by surface tension from the melt. Furthermore, contamination from the container used for melting is nil and, by measuring the area of the nonmetallic inclusions thus released and floating on the surface of the remelted sample, the total amount of the inclusions contained in the molten steel can be determined quickly.

However, depending on the kind of steel and the casting conditions, simply knowing the total amount of the nonmetallic inclusions in the molten steel may not be sufficient to predict the quality of cast steel earlier mentioned. For example, in cases where the composition of the nonmetallic inclusions varies greatly when the molten steel is poured from the ladle into the tundish, particularly when ladle slag flows out at the end of the pouring, it is necessary to quickly know the composition of the nonmetallic inclusions as well. The present inventor et al. have found that the composition can be quickly determined quantitatively by analyzing with fluorescent X-rays the nonmetallic inclusions caused to float up to the surface of the molten sample by the cold crucible, and have already filed a patent application as Japanese Unexamined Patent Publication No. 7-054810. Furthermore, the present inventor et al. have also found that an inclusion size distribution can be estimated by measuring the sizes of the nonmetallic inclusions floating on the surface of the sample by using an image analysis technique, and by statistically processing the measured results, and have already filed a patent application as Japanese Unexamined Patent Publication No. 8-012370.

When the nonmetallic inclusions float to the surface of the melted steel sample, agglomeration of the respective nonmetallic inclusions usually occurs, but by limiting the melting conditions in the cold crucible, the agglomeration can be kept to a minimum, as a result of which the inclusion size distribution of the nonmetallic inclusions over a wide range of size from several microns to several hundred microns can be estimated by measuring the sizes of the inclusions and statistically processing the measured results. This has made it possible to quantitatively determine, quickly and with high accuracy, the cleanliness of the molten steel where the sample was taken, as well as the cleanliness of the cast steel resulting from the solidification of the same molten steel.

However, these methods are only capable of quantitative determination of the cleanliness only of the molten steel corresponding to portions where samples were taken; furthermore, the number of samplings is limited by the operating conditions and cost considerations, and in general the number is limited to a few or less per casting. The above rapid analysis method by itself is therefore no more than a means for providing a typical cleanliness of cast steel from the same charge.

The present invention combines techniques for quantitatively evaluating steel cleanliness rapidly and with high accuracy, including the above-described cold crucible technique, with simulation calculations of the composition, weight, inclusion size, etc. of nonmetallic inclusions occurring in the continuous casting process, and calculates in time series the behavior of the inclusions in the ladle, tundish, and mold and the continuous distribution of the nonmetallic inclusions in cast steel throughout a charge or casting, thereby making it possible to predict the cleanliness of the molten steel and the resulting quality of the cast steel in relation to the cleanliness. The invention also aims at minimizing the amount of the nonmetallic inclusions entrapped in the cast steel by controlling, based on the quality prediction information, process variables such as the amount of slag outflow at the charge port from the ladle to the tundish, the amount of molten steel outflow, the amount of molten steel in the tundish, the casting speed, the electromagnetic stirring pattern in the mold, and the electromagnetic brake strength.

The simulation calculations used in the invention to calculate the behavior of nonmetallic inclusions do not necessarily require high-accuracy calculations involving constructing a previous basic equation strictly faithful to the physical phenomena, but can be accomplished by a relatively simple construction. The simplification of the calculations, that is, the enhancement of accuracy in high-speed calculations, can only be made possible by repeating checks and error corrections by rapid and high-accuracy quantitative measurements of steel cleanliness over successive charges.

Needless to say, the construction of the simulation calculations varies depending on the construction of the process; for example, in cases where the variation of the nonmetallic inclusions in the ladle is smaller than that in the tundish or mold and does not have a significant effect on quality management, the amount of the nonmetallic inclusions in the ladle can be assumed to be constant. In general, however, flow phenomena such as (1) the fluid motion of molten steel in the ladle being caused by heat convection and a charge stream, (2) entrainment of the slag on the surface of molten steel in the ladle at the ladle charge port; (3) entrainment of atmosphere gas and ladle slag into the molten steel in the tundish caused by a charge stream from the ladle, (4) the fluid motion of molten steel in the tundish considering the charge stream from the ladle, charge stream into the mold, and heat convection, (5) entrainment of tundish slag on the surface of molten steel in the tundish caused by the fluid motion of the molten steel in the tundish, (6) deposition and peeling of inclusions inside the submerged entry nozzle, (7) entrainment of argon gas into the molten steel in the submerged entry nozzle, (8) fluid motion caused in the mold by the submerged entry nozzle, (9) correction of the fluid motion in the mold by electromagnetic stirring pattern within the mold or by magnetic brake strength, and (10) entrainment of mold lubricating flux in the meniscus of the molten steel in the mold, must be considered in addition to the behavior of nonmetallic inclusions, such as (A) floating of nonmetallic inclusions formed from deoxidation products, ladle slag, mold lubricating flux, etc. existing in the molten steel, (B) agglomeration of nonmetallic inclusions, and (C) uniting of nonmetallic inclusions with gasses existing in the molten steel and floating thereof, and chemical reactions such as (a) reaction of molten steel ingredients with various nonmetallic inclusions and (b) reaction of slag and flux on molten steel surface with molten steel ingredients and nonmetallic inclusions. By incorporating these factors in the simulation calculations, the invention predicts the cleanliness of molten steel, and continuously predicts the quality of cast steel by further considering (c) the entrainment of bubbles and nonmetallic inclusions into the solidified shell.

When predicting the behavior of nonmetallic inclusions in molten steel, if it was attempted to predict the actual phenomenon by calculation only, numerous diverse factors other than the above-enumerated factors would have to be considered, and the amount of time required for the numerical calculations would be enormous, rendering the calculations impracticable in terms of both cost and time. If the calculations were simplified, the obtained results would be nothing but qualitative and would count for nothing as quality prediction means. On the other hand, when a rapid and high-accuracy analysis method, exemplified by the cold crucible method, was used alone, the obtained results would be accurate, to be sure, but it would be only possible to know the cleanliness of portions where samples are taken.

The present invention achieves a highly accurate prediction within a realistic time by using the cold crucible method in conjunction with simulation calculations. The-present inventor et al. have also found that practically feasible prediction means can be provided by using a previously practiced nonmetallic inclusion evaluation method in conjunction with the simulation calculations in the quantitative determination of inclusions, though certain limitations are imposed on manufacturing conditions. That is, the composition of inclusions cannot be determined quantitatively by an electron beam method that melts a sample with an electron beam in a vacuum and measures the amount of inclusions floating on the surface of molten steel, an ultrasonic method that measures the size and position, i.e, the amount and distribution, of inclusions in steel by ultrasonic waves, or by a total oxidation method that tries to determine the amount of oxygen in molten steel containing nonmetallic inclusions by melting a sample in a graphite crucible and measuring the amount of generated carbon dioxide gas; however, by limiting the manufacturing conditions and the type of steel, the prediction of cleanliness becomes possible by combining the information obtained by these methods with the simulation calculations.

For example, when the type of steel for which the prediction is to be made is aluminum killed steel, the principal inclusion is alumina; in this case, under manufacturing conditions where the formation of slag-based inclusions is kept to a minimum by taking measures to prevent the entrainment of ladle slag, tundish slag, mold lubricating flux, etc., the composition of nonmetallic inclusions does not change at all during the process. In such cases, the above-described known methods can be applied.

It is also effective in enhancing the accuracy to measure the composition, weight, and size distribution of nonmetallic inclusions by using any of these known methods in conjunction with the cold crucible method and to combine the results with the simulation calculations.

It takes several minutes to a few dozen minutes to measure the cleanliness of steel in this process. The results are combined with the simulation calculations by changing various coefficients in the calculations and by comparing the measured results with the calculated results, after the prescribed measuring time.

The behaviors of nonmetallic inclusions in the ladle, tundish, mold, and cast steel are calculated in real time, the accuracy of the calculations is checked by spot sampling a few dozen minutes later, and if any errors are found, corrective calculations are performed instantly; in this way, the continuous distribution of nonmetallic inclusions in the cast steel is accurately calculated and evaluated. With this arrangement, since the degree of contamination by inclusions can be evaluated with much higher accuracy than the piecewise management previously practiced using the amount of ladle slag outflow, the clogging of the submerged entry nozzle, channelling in the mold, etc. as operating indexes, only cast steel pieces that satisfy the required level of nonmetallic inclusions can be selectively supplied to the subsequent hot rolling process; this not only serves to simplify quality management but contributes to drastically reducing the rate of nonmetallic-inclusion-induced product failures discovered after the rolling process.

Furthermore, during the continuous casting process where given operating conditions are set for each kind of steel, the simulation calculations accompanied by checks and corrections by the rapid analysis method is repeated for each charge; therefore, real-time calculations for any given charge can be expected to provide a prediction with high accuracy even if spot sampling data for the same charge is not checked.

In this way, information on the cleanliness of the molten steel and the quality of the cast steel can be obtained in real time. If process variables, such as the amount of slag outflow at the charge port from the ladle to the tundish, the amount of molten steel outflow, the amount of molten steel in the tundish, the casting speed, the electromagnetic stirring pattern, and the electromagnetic brake strength, are controlled based on the obtained information, then it becomes possible to control the amount of nonmetallic inclusions entrapped in the cast steel to a minimum level.

An embodiment of the present invention will be described below with reference to the accompanying drawings. FIG. 1 is a diagram schematically illustrating a continuous casting process. The illustrated arrangement comprises a ladle 1, a tundish 2, and a mold 3, with the addition of a long nozzle 4 for pouring molten steel 10 from the ladle 1 into the tundish 2 and an submerged entry nozzle 5 for pouring the molten steel 10 from the tundish 2 into the mold 3. The tundish 2 is also provided with a weir 6 to prevent tundish slag 12 from flowing into the mold 3. The tundish weight is constantly measured by a load cell 9.

An electromagnetic brake 8 is arranged inside the mold 3 in order to suppress an uneven flow of a charge stream. To detect channelling in molten steel in the mold, a total of 80 thermocouples (not shown) are arranged on the cooling water side of the mold, and a pair of mold fluid level sensors 13 are disposed above the meniscus on both sides of the submerged entry nozzle 5.

Information on various operating conditions during casting is constantly input at intervals of two seconds from a process computer to a computer that performs calculations to predict the behavior of nonmetallic inclusions. The behavior of the inclusions from the ladle 1 to the tundish 2 and to the mold 3 and the change of their behavior over time are calculated and predicted by also considering the effects of variations in the operation, and a three-dimensional distribution within a final cast product is quantitatively calculated (primary calculation) in real time for each kind and size of nonmetallic inclusion.

To assure calculation accuracy, molten steel specimens from the ladle 1, the tundish 2, the mold 3, etc. and specimens cut from the cast steel are taken by spot sampling, and sent through a pneumatic tube to an analysis room where the inclusion size distribution is measured for each kind of nonmetallic inclusion by using the cold crucible method. The result of the prediction is checked for each charge, and for a charge for which the error exceeds a certain level a corrective calculation (secondary calculation) is performed.

As a result of successive improvements so far made on the analysis methods and samplers by the present inventor et al., the cold crucible analysis time, including the time required to take and adjust samples, has been reduced to about 20 minutes.

Figure 2:
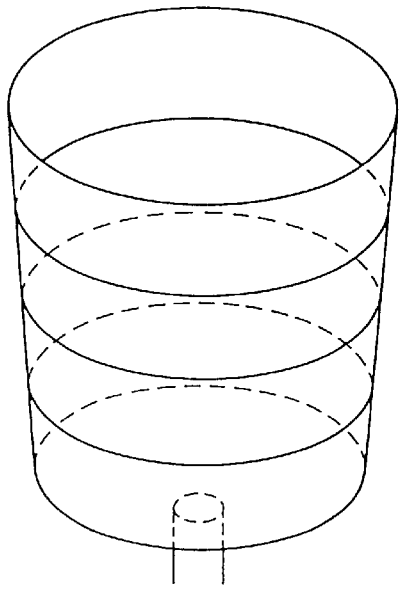
FIG. 2 is a diagram showing an example of calculation meshes in a prediction model for predicting inclusions in a ladle.

Next, prediction models for predicting the behavior of nonmetallic inclusions in the molten steel will be described below with reference to FIGS. 2 to 7B. FIGS. 2, 3, and 4 respectively show examples in which the molten steel in the ladle, the tundish, and the mold, respectively, is divided into calculation spaces. The molten steel is divided into four spaces in the ladle and eight spaces in the tundish, while in the mold the molten steel is divided into 180 spaces including those corresponding to the solidified shell (as indicated by vertical hatching). Thus, the molten steel flow during the continuous casting process is represented with respect to meshes amounting to 192 divisions in total.

Previously, when evaluating inclusions by calculation via a numerical simulation, it has been necessary to calculate the flow patterns in the ladle, the tundish, and the mold by the flow analysis based on the Navier-Stokes equations; finding stable solutions requires dividing each molten steel container into several thousand to hundreds of thousands of calculation meshes for which the balance between flow and pressure has to be calculated by a lengthy process. Therefore, it has been practically impossible to predict the changes in the flow caused by constantly changing volumes, sporadic nozzle clogging, etc. For example, an example of the calculation performed by a research group including one of the present inventors to analyze only the molten steel flow in the ladle is shown in ISIJ International, Vol. 35 (1995), No. 5, pp. 472. As described in Chapter 3.4 in the same document, to perform a steady-state calculation of a certain level, the molten steel was divided into 8000 meshes (20×20×20), and the calculation took more than two hours using a workstation (Sun-Sparc 10).

A major feature of the models used in the present invention is that they provide a drastic reduction in the number of meshes and the calculation time; that is, in constructing the models, a typical pattern of the molten steel flow in the process and the effects that the change in the molten steel amount and casting speed, the fluid motion caused by heat convection, channelling within the mold, etc. have on that pattern are examined in advance using a water model and numerical calculations, and flow conditions under various operating conditions are stored as patterns so that a suitable pattern can be selected based on actual operation data. Since 1000 or less calculation meshes will suffice for the purpose, the calculation for prediction can be carried out in real time using a computer having capabilities comparable to a workstation; if there is no need to calculate a detailed distribution of inclusions in the mold, the calculation for prediction can be done with a few dozen meshes.

Each model illustrated in the example handles four kinds of nonmetallic inclusions: an alumina-based nonmetallic inclusion caused by oxygen entering through the molten steel surface; a slag-based nonmetallic inclusion caused by the entrainment of slag in the ladle or the tundish; a mold-lubricating-flux-based nonmetallic inclusion caused by the entrainment of lubricating flux applied to mold surfaces; and fine bubbles formed by the separation in the mold of Ar gas blown to prevent the clogging of the submerged entry nozzle. The fine bubbles formed in the mold tend to contain numerous fine nonmetallic inclusions adhering therein, leading to imperfections similar to those caused by nonmetallic inclusions; therefore, the fine bubbles are treated here as a form of nonmetallic inclusion.

The inclusion size distribution in one space mesh, which represents the nonmetallic inclusion density profile of the same mesh, is actually a continuous function, but for the convenience of calculation, the inclusion sizes are classified into five typical sizes ranging in diameter from 10 to 1000 microns. Therefore, the calculations performed here handle a total of 20 kinds of inclusions, that is, four kinds classified according to the cause of formation, each further classified into five kinds according to the size. As is apparent from the cause of formation, in the calculations for the ladle and tundish there is no need to perform calculations on the mold-lubricating-flux-based nonmetallic inclusions or on the fine bubbles.

Assuming that nonmetallic inclusions are uniformly distributed within one mesh, the time rate of change of the nonmetallic inclusion density $C_x$ (number/m$^3$) in the X-th mesh (hereinafter referred to as the X mesh) is expressed based on the following theory, considering the molten steel flow and floating.

$$\text{Floating speed of inclusion } U(m/s) = (\rho_m - \rho_i) g \cdot d^2 / 18\mu \quad (1) \text{ (Stokes equation)}$$

where $\rho_m$ and $\rho_i$ are the molten steel and nonmetallic inclusion densities (kg/cm$^3$), g is the gravitational acceleration (9.8 m/s$^2$), d is the inclusion diameter (m), and $\mu$ is the molten steel viscosity (Pa·s).

Hence, the nonmetallic inclusion inflow speed $F_{in}$ (number/s) due to the floating from the mesh directly below and the outflow floating speed $F_{out}$ (number/s) to the mesh directly above are $$F_{in} = C_{under} \cdot U \cdot S_2 \quad (2)$$

$$F_{out} = C_{up} \cdot U \cdot S_1 \quad (3)$$

where $C_{under}$ and $C_{up}$ are respectively the nonmetallic inclusion densities (number/m$^3$) of the meshes directly below and above the X mesh, and $S_1$ and $S_2$ are the areas (m$^2$) of the upper and lower surfaces of the X mesh.

Further, the inclusion inflow rate $R_{in}$ (number/s) from the upstream mesh due to molten steel flow and the inclusion outflow rate $R_{out}$ (number/s) to the downstream mesh are expressed respectively as $$R_{in} = \Sigma C_{X-N} \cdot Qf_{X-N} \quad (4)$$

$$R_{out} = C_X \cdot \Sigma Qf_X \quad (5)$$

where Qf is the molten steel outflow rate (m$^3$/s) to a specific mesh, and the subscript X-N is the mesh from which molten steel flows into the X mesh, these parameters being determined from a flow pattern. Examples of flow patterns are shown by arrows in FIGS. 3 and 4. Since the flow into the X mesh and the flow out of the X mesh can occur with respect to a plurality of meshes, Σ is added to indicate the summation of them.

Accordingly, the inclusion density $C_x(t+1)$ after unit time (1s) is predicted by the following equation.

$$C_x(t+1) = C_x + (R_{in} - R_{out} + F_{in} - F_{out})/V_x \quad (6)$$

where $V_x$ is the volume (m$^3$) of the X mesh.

For the basic motion, excluding the formation, growth by agglomeration, etc. of nonmetallic inclusions within a mesh hereinafter described, the above equation is used as the basic equation, and the change of the nonmetallic inclusion density in each mesh is calculated for each of the 20 kinds of inclusions. The temporal and spatial boundary conditions such as the calculation start at the start of charging and the handling of walls have previously been determined appropriately by engineers in charge according to the circumstances, but at the present time, it is difficult to express them by a given equation.

The number of times (number/s) that agglomeration occurs because of collisions of nonmetallic inclusions a and b of different kinds (densities $C_a$, $C_b$ (number/m$^3$)) within a mesh, is defined in turbulence theory as $$N = k \times \epsilon \times C_a \times C_b \times V_x \quad (7)$$

where ϵ is the average turbulence rate (Watt/m$^3$) in the mesh, which can be determined from a water model test with a tracer added, detailed numerical calculations, etc. as in the case of flow patterns, and k is a proportionality constant. Thus, the decrease in the number of nonmetallic inclusions and the increase in size due to the occurrence of collision-induced agglomeration are calculated in such a manner as to form larger size inclusions by subtracting a number corresponding to the number of occurrences of agglomeration and maintaining the condition that preserves the overall volume. When an alumina-based nonmetallic inclusion unites with a slag-based nonmetallic inclusion, for example, the high-melting-point solid alumina-based nonmetallic inclusion is absorbed into the low-melting-point slag-based nonmetallic inclusion to form a slag, as was discovered in an investigation of actual operation; therefore, such a phenomenon was treated as the formation of a larger size slag-based nonmetallic inclusion, and in the case of agglomeration of other dissimilar inclusions, appropriate classifications were done in like manner.

Further, the removal speed M (number/s) of slag from the ladle and tundish surfaces or of lubricating flux in the mold was evaluated as a function of the average turbulence rate ϵ, inclusion diameter d, and slag (or lubricating flux) viscosity $\mu_s$ (Pa·s), based on a water model, a basic experiment conducted using molten steel and slag, a field investigation of actual equipment, etc.

$$M = f(\epsilon, d, \mu_s) \quad (8)$$

It is assumed that the formation of alumina due to contamination from the oxygen and air in the slag occurs in the uppermost meshes in the ladle, the tundish, and the mold, and since it is considered in theory that the contamination speed L (number/s) is proportional to the oxygen activity $a_o$ (–), oxygen partial pressure $P_{o2}$ (Pa) in atmosphere, and surface area S1 ($m^2$), $$L=\gamma\times S1\times\epsilon\times(f1(d)\times a_o+f2(d)\times P_{o2}) \quad (9)$$

where f1 and f2 are functions describing the formation of alumina inclusions by slag oxidation and atmosphere oxidation, respectively, and γ is a function representing the ratio of the thus formed inclusions that enter the molten steel without staying in the slag.

Figure 5A:
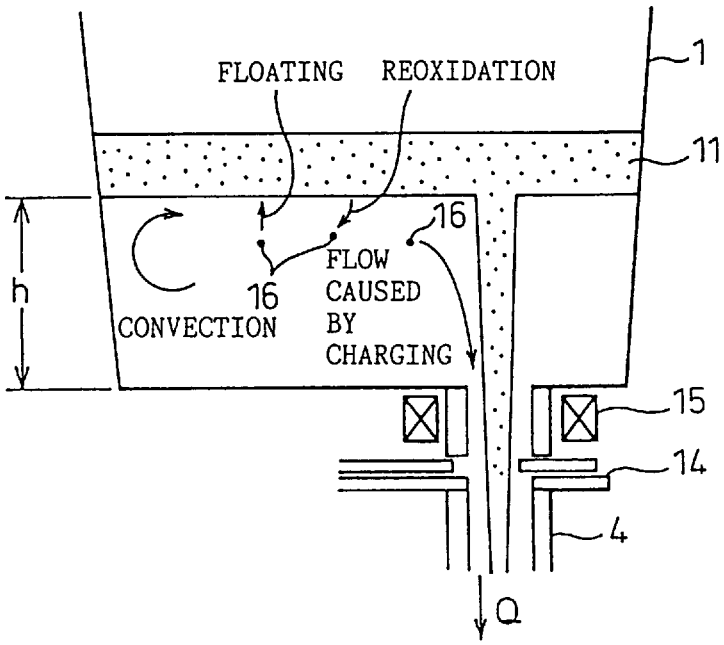
FIGS. 5A and 5B are diagrams conceptually illustrating the prediction model for predicting inclusions in the ladle.
Figure 5B:
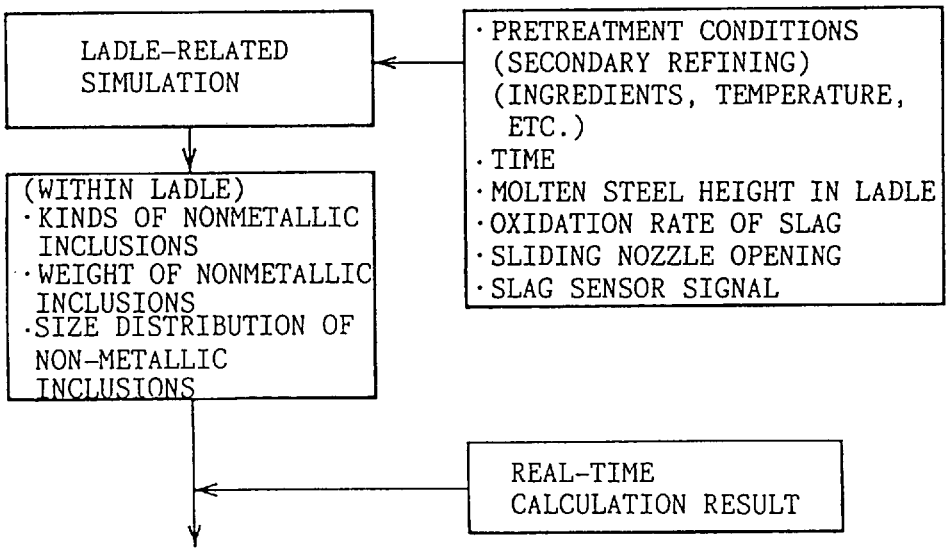

FIGS. 5A and 5B are diagrams conceptually illustrating a prediction model for predicting the inclusions in the ladle. The time required between the end of secondary refining and the start of charging from the ladle into the tundish (hereinafter called the ladle charge start) is about 30 minutes. Based on the sample analysis value at the end of the secondary refining, the amount of change that occurs in the slag-based and the alumina-based inclusions because of the removal of nonmetallic inclusions 16 by floating and the formation of nonmetallic inclusions by reoxidation from ladle slag 11 over the time from the end of the secondary refining to the ladle charge start, is calculated based on bubbling time, retention time, ladle slag oxidation rate $a_o$, etc., to determine the ladle inclusion distribution at the ladle charge start and set it as the initial condition.

The amount of nonmetallic inclusions flowing through the long nozzle 4 into the tundish, as well as the behavior of the nonmetallic inclusions 16 in the ladle during the period from the ladle charge start to the ladle charge end, is calculated and predicted in real time. Ladle slag 11 floating on top of the molten steel in the ladle mixes into the tundish because of the swirling that occurs near the end of a charge, leading to quality degradation of cast steel produced from portions between charges. The amount of slag that enters the nozzle can be expressed using a typical mixing speed predicted from the height h (m) of the molten steel remaining in the ladle and the charging speed q ($m^3$/s), but the amount of mixing for each charge can be evaluated with higher accuracy by continually measuring the ladle slag inflow rate using a ladle slag flow sensor 15 that detects the impedance change in the nozzle caused by slag mixing. Accordingly, the speed y ($m^3$/s) at which the ladle slag is swirled into the tundish can be evaluated as shown in the following equation.

$$y=R_{slag}\times q \quad (10)$$

where q is the flow rate ($m^3$/s) of the fluid passing through the nozzle, and $R_{slag}$ is the slag load factor (–) in the long nozzle 4 and is given as $$R_{slag}=f(h,\ q) \text{ or } R_{slag}=f(\text{sensor signal})$$

Figure 6A:
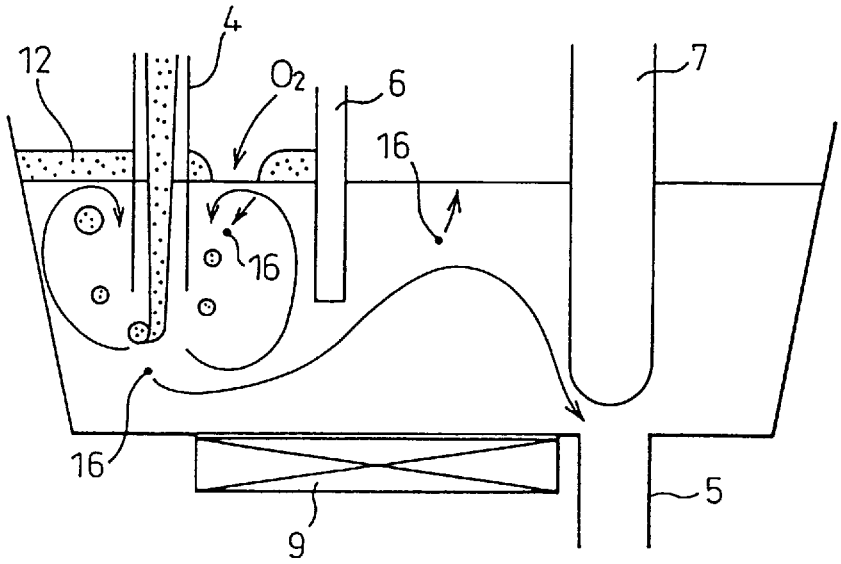
FIGS. 6A and 6B are diagrams conceptually illustrating the prediction model for predicting nonmetallic inclusions in the tundish.
Figure 6B:
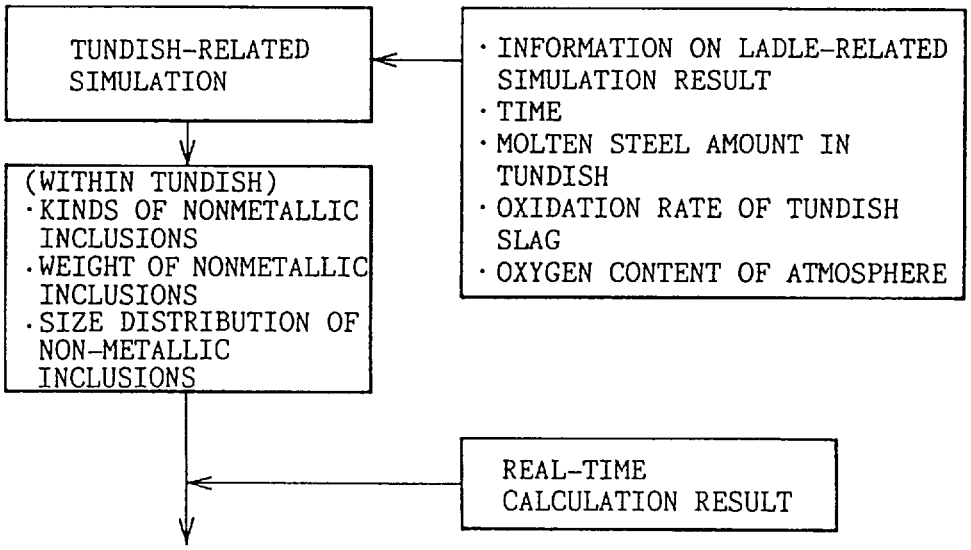

FIGS. 6A and 6B are diagrams conceptually illustrating a prediction model for predicting the nonmetallic inclusions in the tundish. The outlet condition calculated by the above-described ladle model is given as the inlet condition of the molten steel and nonmetallic inclusions in the tundish model. The inlet is in a highly turbulent condition because of the molten steel streaming through the long nozzle 4, and not only the formation of slag-based nonmetallic inclusions and the formation of a large number of alumina-based nonmetallic inclusions by reoxidation occur, but slag-based nonmetallic inclusions are also formed because of the drawing of the ladle slag by the swirling motion described above. The rate of formation Y (number/s) is given by $$Y=f(d)\times y \quad (11)$$

where f(d) is a function describing the size distribution of the inclusions formed by the drawing of the swirling ladle slag, and has been determined based on a basic experiment and a field investigation of actual equipment.

As for the nonmetallic inclusions deposited inside the submerged entry nozzle 5 and the timing of their peeling, the effects that the degree of clogging of the submerged entry nozzle 5 has on the relationship between the casting speed and the opening of a stopper 7, are examined in advance, and the amount of nonmetallic inclusion deposition is predicted from the casting speed and the stopper opening. It is assumed that separated inclusions will flow into the mold. Here, the inclusions adhering to the inside of the submerged entry nozzle are determined as alumina-based inclusions from the experience obtained through the past investigations of actual conditions, and the inclusion size distribution also is determined based on the investigations of actual conditions.

Figure 7A:
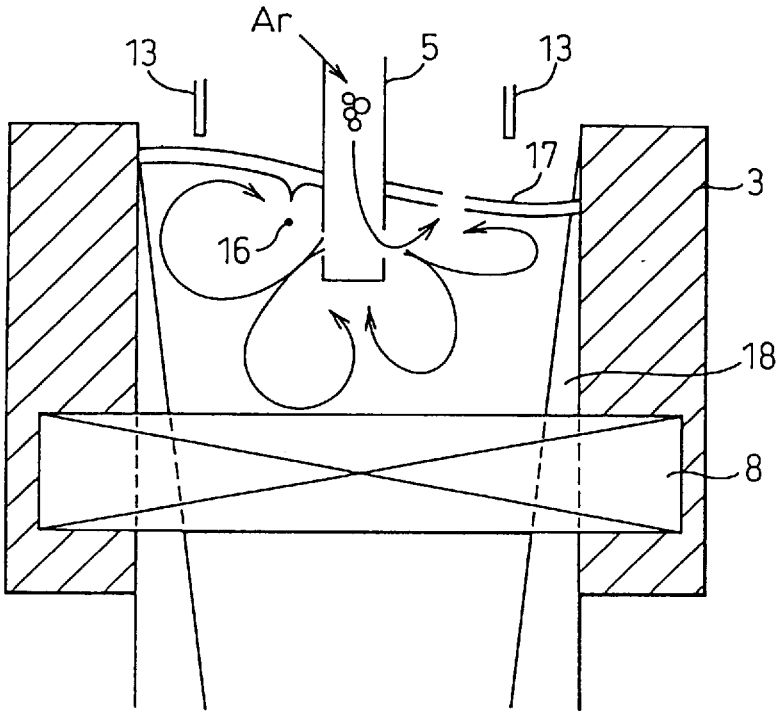
FIGS. 7A and 7B are diagrams conceptually illustrating the prediction model for predicting nonmetallic inclusions in the mold.
Figure 7B:
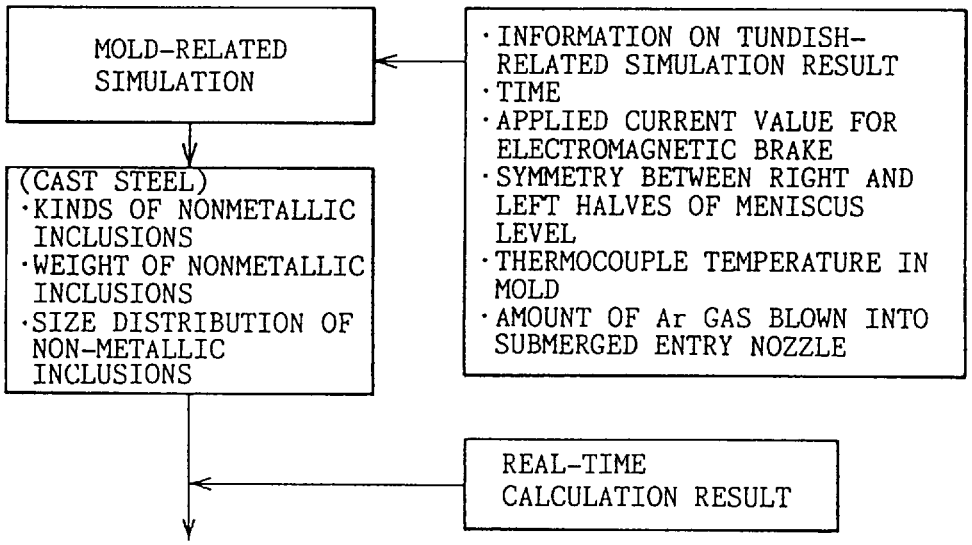

FIGS. 7A and 7B are diagrams conceptually illustrating a prediction model for predicting the nonmetallic inclusions in the mold. The outlet condition calculated by the tundish model is given as the inlet condition of the molten steel and nonmetallic inclusions in the mold model. For the flow in the mold, the flow pattern is predicted from the operating conditions, based on the results of a numerical analysis performed in advance by varying the casting speed and electromagnetic brake strength, while for channelling which is continually detected based on the difference in temperature distribution between the right and left thermocouples in the casting mold and using the mold fluid level sensor 13, the expected amount of variation between right and left is evaluated by considering the flow pattern.

As for the formation of fine bubbles due to the argon gas blown into the submerged entry nozzle to prevent clogging, the rate of formation is determined by investigating the relationship between the amount of the argon gas and the frequency of occurrence of bubble distributions. When these nonmetallic inclusions have reached a calculation mesh directly bordering on the solidificated shell (a mesh indicated by oblique hatching in FIG. 5), Z(%) of the inclusions are captured by the solidificated shell in that calculation mesh.

$$Z=f(d,\ Qf,\ \text{inclusion composition}) \quad (12)$$

With the above calculation logic, a three-dimensional distribution of nonmetallic inclusions in the final cast product can be calculated and predicted in real time for each kind of nonmetallic inclusion and for each inclusion size.

Figure 8:
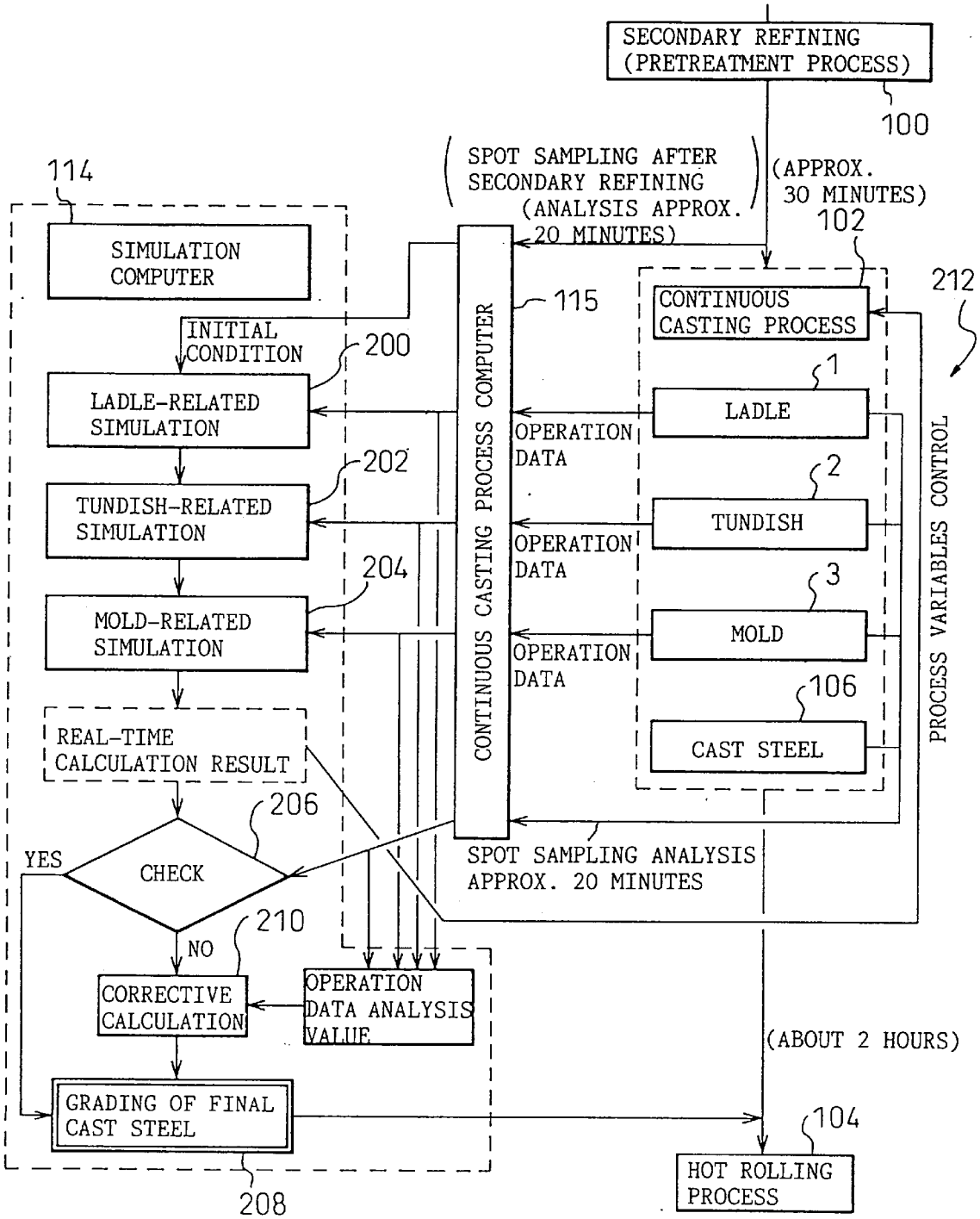
FIG. 8 is a diagram schematically showing the connections between simulation calculations and nonmetallic inclusion rapid analyses.

FIG. 8 shows schematically the connections between the prediction models and the cold crucible analysis values. In the right side of FIG. 8 is shown the production process consisting of a secondary refining process 100, a continuous casting process 102, and a hot rolling process 104. It takes about 30 minutes to transport the molten steel from the outlet of the secondary refining process 100 to the inlet of the continuous casting process 102. There is an interval of about two hours from the time the cast steel is output from the continuous casting process 102, until it is delivered to the hot rolling process 104.

Operation data from the ladle 1, the tundish 2, and the mold 3 in the continuous casting process 102 are fed to a continuous casting process computer 115. Spot sampling is performed on the molten steel at the outlet of the secondary refining process 100 and at designated places on the ladle 1, the tundish 2, and the mold 3, and also on the cast steel 106 drawn out of the mold 3. Sample analysis is finished in about 20 minutes.

In the left side of FIG. 8 is shown the simulation flow in a simulation computer 114 which is a workstation or the like. In FIG. 8, the inclusion distribution in the ladle at the ladle charge start, calculated from the result of the analysis at the outlet of the secondary refining process 100, is set as the initial condition, and a ladle-related simulation is performed using a model supplied with the operation data of the ladle 1 via the continuous casting process computer 115 (step 200). Next, by setting the ladle outlet condition as the tundish inlet condition, a tundish-related simulation using the operation data of the tundish 2 is performed (step 202). The tundish outlet condition is then input as the mold inlet condition into a model supplied with the operating condition of the mold 3, and a mold-related simulation is performed (step 204) using this operating condition. The results of these simulations are compared with the results of the analysis of the spot sampling taken at the respective portions (step 206). If they are within an allowable range, the prediction by the simulations is determined to be correct, and the cast steel is graded accordingly (step 208). If the results of the simulations and the results of the analysis are not within the allowable range, parameters of the models are corrected as will be described later (step 210).

The nonmetallic inclusion distribution (the result of the primary calculation) in the continuous casting process calculated in real time retains a prediction accuracy higher than a certain level even before the results of the analysis for the current charge become available, since the accuracy check has been repeatedly performed up to the preceding charge by spot-sampling and quickly analyzing the molten steel specimens taken from the ladle, tundish, and mold and the specimens cut from the cast steel.

This also makes control possible appropriate to the degree of contamination by nonmetallic inclusions during continuous casting (step 212 in FIG. 8). For example, when the number of nonmetallic inclusions in the tundish is more than the required level, the casting speed can be reduced to allow more time for the inclusions to float to the surface before solidification begins in the mold; in this way, the required quality can be maintained. Furthermore, if a metal such as Ca or Mg, a material expensive but highly effective in suppressing nonmetallic inclusions in the tundish, is added only when the degree of contamination is high, an effective operation can be achieved. As an example of an action taken for the mold, if the equipment is of the type capable of electromagnetic stirring in the mold, an agitation pattern that does not cause chafing of the lubricating flux can be selected and maintained. Furthermore, in the case of equipment capable of suppressing the drawing of inclusions using an electromagnetic brake, a coil current appropriate to the level of inclusions can also be selected and maintained. The on-line control of operation as described above can be performed either manually by an operator on the basis of the prediction information or automatically by having a computer learn optimum control patterns.

If an error larger than a certain level occurs between the analysis value by spot sampling and the calculated value (the result of the primary calculation), a corrective calculation (secondary calculation) is performed by a simulator. About 20 minutes is required from the time the spot sampling specimens are taken and processed, until the result of the analysis becomes available. The secondary calculation interlinked with the operation data stored in a hard disk for a predetermined period of time can thus be done at a speed less than half that of real time. If the result of the analysis of the spot sampling on the tundish shows that the degree of contamination is lower than that obtained in the primary calculation, the constant k in the equation (7) for the calculation of agglomeration is also used as the fitting parameter, and by changing k to a higher value, the number of occurrences of agglomeration is calculated so as to yield a higher value (to increase the number of inclusions reduced by agglomeration and increase the floating speed by increased average inclusion size), thus making the result match the actual degree of contamination. In this way, a regression calculation can be achieved in a simple manner.

Since there is a time interval of about two hours, including transportation and matching, until the cast steel is fed to the subsequent hot rolling process, an accurate prediction result for the three-dimensional distribution of inclusions in the cast steel can be obtained much earlier than the time that the cast steel reaches the subsequent hot rolling stage even when the secondary calculation is carried out. This not only makes it possible to supply the correctly graded cast steel but prevents troubles such as surface defects and internal defects that would be caused by nonmetallic inclusions in the rolling and later processes.

The mode of embodiment thus far described has dealt with an example that uses the cold crucible method to spot-check the nonmetallic inclusions, but if a rapid analysis is possible, other methods, such as the electron beam method disclosed in Japanese Unexamined Patent Publication No. 64-70134 and the ultrasonic method shown in Japanese Unexamined Patent Publication No. 3-102258, can be used to predict the nonmetallic inclusions for each inclusion size. Further, if it is only necessary to know the contamination by nonmetallic inclusions on a macroscopic scale, a continuous prediction of nonmetallic inclusions can also be done by combining a steel oxygen analysis method such as the one defined in JIS Z2613 with a macro simulation of its total oxygen amount.

Software for implementing the above functions on a general-purpose computer, including a workstation, can be supplied on a known recording medium such as a floppy disk or a CD-ROM.

The mode of embodiment shown here has dealt in detail with only one example of the application of the present invention, and it will be recognized that the simulation calculation logic, spot sampling places, etc. should be determined by the required nonmetallic inclusion level and processing constraints.

EXAMPLE 1

After refining molten steel for making steel sheets, in a three charge converter, each charge consisting of 300 tons, each charge was degassed and adjusted for its ingredients in secondary refining equipment (RH degassing. equipment), and then transferred to a continuous casting process. Tundish capacity was 50 tons, the continuous-casting mold was 250 mm (thickness)×1800 (width), and the casting speed in steady regions was 2.5 m/minute. Samples were taken from the molten steel in the ladle, the tundish, and the mold, respectively, at an average rate of one for every 15 minutes, and rapid inclusion precipitation was performed using the cold crucible method.

The measured results of the inclusion composition and inclusion size distribution were combined with the simulation calculations of the behavior of nonmetallic inclusions, and the quality of cast steel was predicted. This prediction operation was started at the start of the casting and continued until the process proceeded to an intermediate point through the second charge. Thereafter, the quality of cast steel was estimated by only analyzing the nonmetallic inclusions in the sampled pieces.

Figure 9:
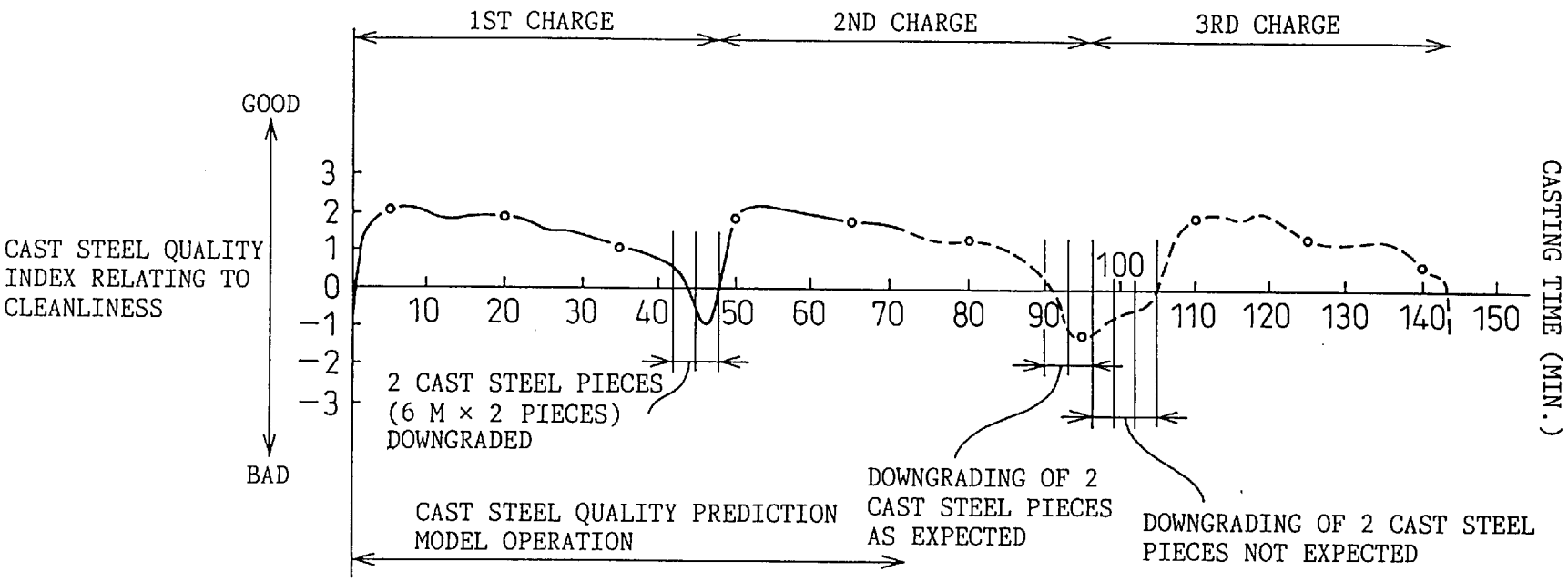
FIG. 9 is a diagram showing the prediction result of cast steel quality in relation to cleanliness and portions where samples were taken from molten steel in a continuous-casting tundish.

The results are shown in FIG. 9. The sampling points were plotted, and the solid line shows the result of the prediction by the simulation calculations of the behavior of nonmetallic inclusions. The beginning of the first charge is a non-steady region attending the start of charging, where the cleanliness index representing the cast steel quality is below an acceptable level of 0. On the other hand, in the steady region, the quality exceeded the acceptable level, though there was observed a minor variation in the quality.

In the region between the first charge and the second charge, the cleanliness of the molten steel further decreased because of the drawing of ladle slag, coupled with the fact that the cleanliness of the molten steel poured in from the ladle was low. As the process entered the steady region of the second charge, the cleanliness stabilized at a high level, so that the continuous quality prediction by the nonmetallic inclusion behavior simulation calculations was stopped, and thereafter, only a spot check of the cleanliness was performed using the results of the nonmetallic inclusion analysis by sampling.

The results of the nonmetallic inclusion analysis for both the second and third charges showed a cleanliness variation pattern similar to that for the first charge; therefore, after the end of the third charge (the end of the continuous casting), the cast steel was transferred to the rolling process, excluding that portion of the first charge which was below the acceptable level and the portions of the second and third charges which were expected to be below the acceptable level. As a result, no product defects were found from the steady regions of the first and second charges, but surface defects were found in the cast steel from the region between the second and third charges along a length longer than predicted. Responding to this result, the quality of the cast steel was estimated regressively by performing the nonmetallic inclusion behavior calculations based on the operation data logged during the continuous casting and on the results of the analysis of the nonmetallic inclusions. The result is shown by the dotted line in FIG. 9. It was thus confirmed that quality degradation greater than expected had occurred in the region between the second and third charges because of an outflow of a small amount of ladle slag.

EXAMPLE 2

After refining molten steel for making steel sheets in a three charge converter, each charge consisting of 300 tons, each charge was degassed and adjusted for its ingredients in secondary refining equipment (RH degassing equipment), and then transferred to a continuous casting process. Tundish capacity was 50 tons, the continuous-cast mold was 250 mm (thickness)×1800 (width), and the casting speed in steady regions was 2.0 m/minute. Samples were taken from the molten steel in the ladle, the tundish, and the mold, respectively, at an average rate of one for every 15 minutes, and rapid inclusion precipitation was performed using the cold crucible method.

Figure 10:
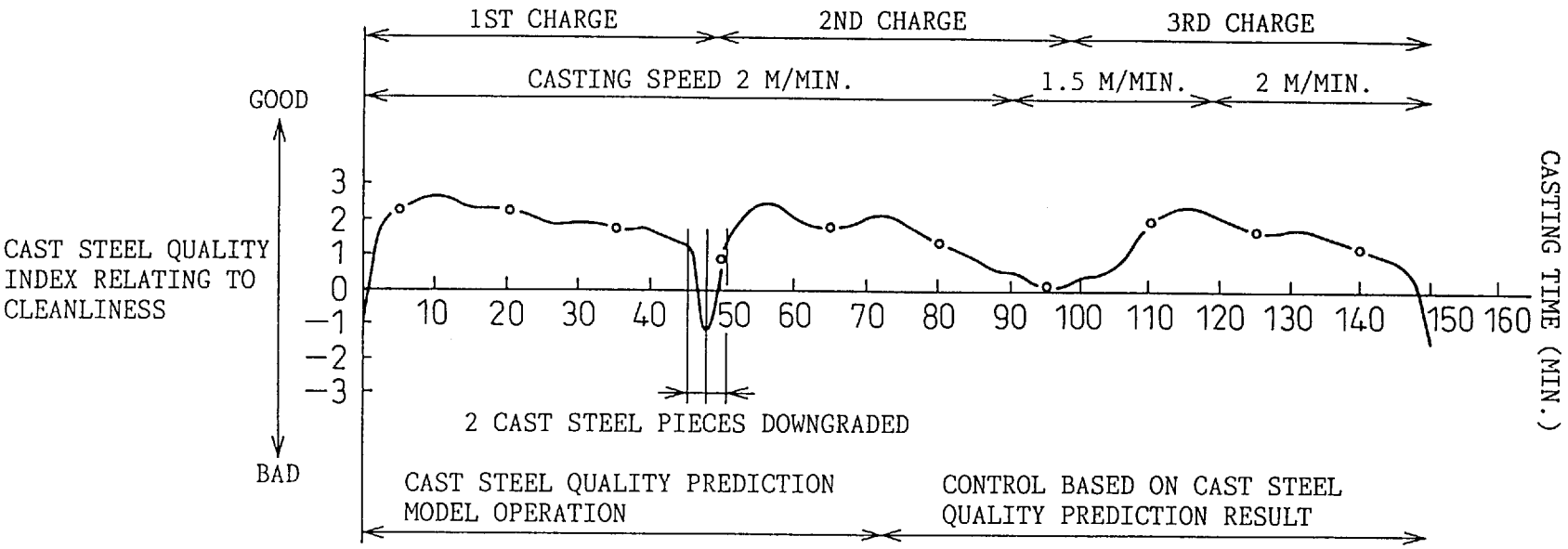
FIG. 10 is a diagram showing the result of cast steel quality when casting speed was controlled based on the prediction result of the cleanliness, as contrasted to when such control was not performed.

The measured results of the inclusion composition and inclusion size distribution were combined with the simulation calculations of the behavior of nonmetallic inclusions, and the quality of the cast steel was predicted. This prediction operation was started at the start of the casting and continued until the process proceeded to an intermediate point through the second charge. Thereafter, the quality of the cast steel was controlled by controlling process variables while, at the same time, predicting the quality of the cast steel. The results are shown in FIG. 10. The sampling points were plotted, and the solid line shows the result of the prediction by the simulation calculations of the behavior of nonmetallic inclusions based on the results of the analysis. Since quality degradation was predicted in the region between the second and third charges, the casting speed was reduced from 2.0 m/minute to 1.5 m/minute, and thereafter brought back to 2.0 m/minute. As a result, while the quality from the region where control was not performed was below the acceptable level and a one rank lower grade had to be assigned, the quality from the region where control was performed was comparable to that from the steady region and did not need to be downgraded. The detrimental effect could thus be kept to a minimum.

As described above, when the simulation calculations using mathematical models for the composition, weight, inclusion size, etc. of nonmetallic inclusions in molten steel and cast steel are used in combination with the results of the rapid analysis of spot sampling specimens, it becomes possible to predict online the quality of the cast steel with high accuracy during continuous casting, enabling the cast steel to be graded correctly before it is transferred to the hot rolling process. Furthermore, since the continuous casting process can be dynamically controlled based on the prediction, the defect rate of the cast steel can be held to a minimum.

We claim:

1. A quality prediction method for continuous-cast steel, comprising the steps of:

continuously calculating a nonmetallic inclusion distribution at an outlet of a ladle;

continuously calculating a nonmetallic inclusion distribution at an outlet of a tundish by inputting the nonmetallic inclusion distribution calculated at the outlet of the ladle into a tundish mathematical model supplied with operation data of the tundish; and continuously predicting the quality of a steel piece cast in a mold by inputting the nonmetallic inclusion distribution calculated at the outlet of the tundish into a mold mathematical model supplied with operation data of the mold.

2. A method according to claim 1, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

3. A method according to claim 2, further comprising the steps of:

prestoring a pattern of the fluid speed and direction applicable in each of the calculation spaces for a plurality of operation data; and selecting a pattern based on supplied operation data.

4. A method according to claim 1, further comprising the steps of:

measuring the nonmetallic inclusion distribution by analyzing a sample taken from at least one point in a process leading from the ladle to the mold;

comparing a result obtained from the measurement with a prediction result of the nonmetallic inclusion distribution at a corresponding place and time in the corresponding mathematical model; and correcting the corresponding mathematical model so that the measured result and the prediction result agree within an allowable range.

5. A method according to claim 4, wherein the step of measuring the nonmetallic inclusion distribution includes the substeps of:

remelting a solidified sample to thereby allow nonmetallic inclusions to float to the surface of the remelted sample; and determining the nonmetallic inclusion distribution in the sample by measuring at least one item selected from among an amount, an area, a composition, and an inclusion size distribution related to the nonmetallic inclusions floating to the surface.

6. A quality control method for continuous-cast steel, comprising the steps of:

continuously calculating a nonmetallic inclusion distribution at an outlet of a ladle;

continuously calculating a nonmetallic inclusion distribution at an outlet of a tundish by inputting the nonmetallic inclusion distribution calculated at the outlet of the ladle into a tundish mathematical model supplied with operation data of the tundish;

continuously predicting the quality of a steel piece cast in a mold by inputting the nonmetallic inclusion distribution calculated at the outlet of the tundish into a mold mathematical model supplied with operation data of the mold; and automatically changing operating conditions based on the predicted quality of the cast steel piece.

7. A method according to claim 6, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

8. A method according to claim 7, further comprising the steps of:

prestoring a pattern of the fluid speed and direction applicable in each of the calculation spaces for a plurality of operation data; and selecting a pattern based on supplied operation data.

9. A method according to claim 6, further comprising the steps of:

measuring the nonmetallic inclusion distribution by analyzing a sample taken from at least one point in a process leading from the ladle to the mold;

comparing a result obtained from the measurement with a prediction result of the nonmetallic inclusion distribution at a corresponding place and time in the corresponding mathematical model; and correcting the corresponding mathematical model so that the measured result and the prediction result agree within an allowable range.

10. A method according to claim 9, wherein the step of measuring the nonmetallic inclusion distribution includes the substeps of:

remelting a solidified sample to thereby allow nonmetallic inclusions to float to the surface of the remelted sample; and determining the nonmetallic inclusion distribution in the sample by measuring at least one item selected from among an amount, an area, a composition, and an inclusion size distribution related to the nonmetallic inclusions floating to the surface.

11. A quality prediction apparatus for continuous-cast steel, comprising:

means for continuously calculating a nonmetallic inclusion distribution at an outlet of a ladle;

means for continuously calculating a nonmetallic inclusion distribution at an outlet of a tundish by inputting the nonmetallic inclusion distribution calculated at the outlet of the ladle into a tundish mathematical model supplied with operation data of the tundish; and means for continuously predicting the quality of a steel piece cast in a mold by inputting the nonmetallic inclusion distribution calculated at the outlet of the tundish into a mold mathematical model supplied with operation data of the mold.

12. An apparatus according to claim 11, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

13. An apparatus according to claim 12, further comprising:

means for prestoring a pattern of the fluid speed and direction applicable in each of the calculation spaces for a plurality of operation data; and means for selecting a pattern based on supplied operation data.

14. An apparatus according to claim 11, further comprising:

means for inputting a result obtained by measuring the nonmetallic inclusion distribution at least one point in a process leading from the ladle to the mold;

means for comparing the measured result with a prediction result of the nonmetallic inclusion distribution at a corresponding place and time in the corresponding mathematical model; and means for correcting the corresponding mathematical model so that the measured result and the prediction result agree within an allowable range.

15. A quality control apparatus for continuous-cast steel, comprising:

means for continuously calculating a nonmetallic inclusion distribution at an outlet of a ladle;

means for continuously calculating a nonmetallic inclusion distribution at an outlet of a tundish by inputting the nonmetallic inclusion distribution calculated at the outlet of the ladle into a tundish mathematical model supplied with operation data of the tundish;

means for continuously predicting the quality of a steel piece cast in a mold by inputting the nonmetallic inclusion distribution calculated at the outlet of the tundish into a mold mathematical model supplied with operation data of the mold; and means for automatically changing operating conditions based on the predicted quality of the cast steel piece.

16. An apparatus according to claim 15, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

17. An apparatus according to claim 16, further comprising:

means for prestoring a pattern of the fluid speed and direction applicable in each of the calculation spaces for a plurality of operation data; and means for selecting a pattern based on supplied operation data.

18. An apparatus according to claim 17, further comprising:

means for inputting a result obtained by measuring the nonmetallic inclusion distribution at least one point in a process leading from the ladle to the mold;

means for comparing the measured result with a prediction result of the nonmetallic inclusion distribution at a corresponding place and time in the corresponding mathematical model; and means for correcting the corresponding mathematical model so that the measured result and the prediction result agree within an allowable range.

19. A program storage device readable by a machine, tangibly embodying a program of instructions executable by the machine to perform method steps for predicting the quality of continuous-cast steel, said method steps comprising:

continuously calculating a nonmetallic inclusion distribution at an outlet of a ladle;

continuously calculating a nonmetallic inclusion distribution at an outlet of a tundish by inputting the nonmetallic inclusion distribution calculated at the outlet of the ladle into a tundish mathematical model supplied with operation data of the tundish; and continuously predicting the quality of a steel piece cast in a mold by inputting the nonmetallic inclusion distribution calculated at the outlet of the tundish into a mold mathematical model supplied with operation data of the mold.

20. A program storage device according to claim 19, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

21. A program storage device according to claim 20, wherein said method steps further comprise:

prestoring a pattern of the fluid speed and direction applicable in each of the calculation spaces for a plurality of operation data; and selecting a pattern based on supplied operation data.

22. A program storage device according to claim 19, wherein said method steps further comprise:

inputting a result obtained by measuring the nonmetallic inclusion distribution at least one point in a process leading from the ladle to the mold;

comparing the measured result with a prediction result of the nonmetallic inclusion distribution at a corresponding place and time in the corresponding mathematical model; and correcting the corresponding mathematical model so that the measured result and the prediction result agree within an allowable range.

23. A program storage device readable by a machine, tangibly embodying a program of instructions executable by the machine to perform method steps for controlling the quality of continuous-cast steel, said method steps comprising:

continuously calculating a nonmetallic inclusion distribution at an outlet of a ladle;

continuously calculating a nonmetallic inclusion distribution at an outlet of a tundish by inputting the nonmetallic inclusion distribution calculated at the outlet of the ladle into a tundish mathematical model supplied with operation data of the tundish;

continuously predicting the quality of a steel piece cast in a mold by inputting the nonmetallic inclusion distribution calculated at the outlet of the tundish into a mold mathematical model supplied with operation data of the mold; and automatically changing operating conditions based on the predicted quality of the cast steel piece.

24. A program storage device according to claim 23, wherein, in the mathematical models, space in the tundish and space in the mold are each divided into a plurality of calculation spaces the number of which is so large as to permit a real-time calculation, each of the calculation spaces being assumed to have a constant fluid speed and direction and a uniform nonmetallic inclusion distribution.

25. A program storage device according to claim 24, wherein said method steps further comprise:

prestoring a pattern of the fluid speed and direction applicable in each of the calculation spaces for a plurality of operation data; and selecting a pattern based on supplied operation data.

26. A program storage device according to claim 23, wherein said method steps further comprise:

inputting a result obtained by measuring the nonmetallic inclusion distribution at least one point in a process leading from the ladle to the mold;

comparing the measured result with a prediction result of the nonmetallic inclusion distribution at a corresponding place and time in the corresponding mathematical model; and correcting the corresponding mathematical model so that the measured result and the prediction result agree within an allowable range.

* * * * *

UNITED STATES PATENT AND TRADEMARK OFFICE

CERTIFICATE OF CORRECTION

PATENT NO. : 5,884,685

DATED : March 23, 1999

INVENTOR(S) : Kazushige UMEZAWA, et al.

It is certified that error appears in the above-identified patent and that said Letters Patent is hereby corrected as shown below:

ABSTRACT, 57 , line 4, delete the period after "behavior".

Column 6, line 47, delete the hyphen between "The" and "present".

Column 18, line 26, change "distribution at least" to --distribution at at least--.

Signed and Sealed this

Eighteenth Day of January, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,884,685

DATED : March 23, 1999

INVENTOR(S) : Kazushige UMEZAWA, et al.

It is certified that error appears in the above-identified patent and that said Letters Patent is hereby corrected as shown below: On title page, item [22], after "PCT Filed:" change "Mar. 26, 1996" to --March 29, 1996--.

Signed and Sealed this

Twenty-first Day of March, 2000

*Attest:*

*Attesting Officer*

Q. TODD DICKINSON

*Commissioner of Patents and Trademarks*